US005235967A

United States Patent [19]

Arbisi et al.

[11] Patent Number: 5,235,967

[45] Date of Patent: Aug. 17, 1993

[54] ELECTRO-MAGNETIC IMPACT MASSAGER

[76] Inventors: Dominic S. Arbisi, 13001 Berkshire Dr., Minnetonka, Minn. 55343; Roger E. Mitchell, 850 S. Longmore, #281, Meza, Ariz. 85202-3180

[21] Appl. No.: 818,486

[22] Filed: Jan. 7, 1992

Related U.S. Application Data

[63] Continuation of Ser. No. 504,342, Apr. 4, 1990, abandoned.

[51] Int. Cl.[5] ..... A61H 1/00

[52] U.S. Cl. ..... 128/24.5; 128/24.2; 128/55; 128/64

[58] Field of Search ..... 128/24.1-24.5, 128/28, 32, 33, 36, 55, 64; 318/129; 363/36, 81; 323/300

[56] References Cited

U.S. PATENT DOCUMENTS

| | | | |
|---|---|---|---|
| 2,674,231 | 4/1954 | Erickson . | |
| 3,310,050 | 3/1967 | Goldfarb . | |
| 3,457,910 | 7/1969 | Vecchio | 128/24.2 |
| 3,664,332 | 5/1972 | Vecchio | 128/41 |
| 3,885,553 | 5/1975 | Vecchio | 128/41 |
| 4,079,733 | 3/1978 | Denton et al. | 128/55 |
| 4,098,266 | 7/1978 | Muchisky et al. | 128/36 |
| 4,102,334 | 7/1978 | Muchisky | 128/55 |
| 4,535,279 | 8/1985 | Arbisi et al. . | |
| 4,585,977 | 4/1986 | Arbisi et al. . | |
| 4,697,581 | 10/1987 | Endo | 128/41 |
| 4,809,684 | 3/1989 | Gardner et al. . | |
| 4,838,263 | 6/1989 | Warwick et al. . | |
| 4,878,010 | 10/1989 | Weber | 323/300 |

FOREIGN PATENT DOCUMENTS 2112225 6/1983 United Kingdom ..... 323/300

*Primary Examiner*—Richard J. Apley
*Assistant Examiner*—Joe H. Cheng
*Attorney, Agent, or Firm*—Kinney & Lange

[57] ABSTRACT

A therapeutic impact massager for massaging a body region of a person. The impact massager includes a frame mounted within a flexible fabric support member. The frame includes a plurality of compartments that movably receive conductive elements. Drive coils are mounted within the compartments adjacent to the conductive elements and produce a first pulsed magnetic field. The first pulsed magnetic field induces a second magnetic field within the conductive elements. The first and second magnetic fields interact to force the conductive elements towards the body region of a person to impact thereupon. A capacitor for storing electrical energy is coupled to the drive coils. A switch is coupled in series with the capacitor and drive coils and is movable between the closed state which allows electrical energy to flow from the capacitor to the drive mechanism, and an open state which prevents the discharge of electrical energy through the drive coils. A microprocessor is coupled to the switch and generates a logic command that shifts the switch between opened and closed states. The microprocessor is configured to energize the drive coils in a periodic and patterned manner to repeatedly force the conductive elements toward the body region which imparts a rhythmic wave massaging effect thereto. The impact massager preferably is in the form of a therapeutic garment that overlies the chest and back of a wearer. The therapeutic garment is designed to be used by persons with cystic fibrosis to alleviate the accumulation of mucus within the lungs.

19 Claims, 3 Drawing Sheets

ELECTRO-MAGNETIC IMPACT MASSAGER

This is a continuation of application Ser. No. 07/504,342 filed on Apr. 4, 1990, abandoned as of the date of this application.

BACKGROUND OF THE INVENTION

This invention relates generally to therapeutic massagers. In particular, the present invention is an electro-magnetic impact massager incorporated into a garment that can be worn about the chest and back, which aids in the loosening and elimination of mucus from the lungs of a person. Specifically, the impact massager would be useful to a person affected by cystic fibrosis.

Cystic fibrosis is a deadly, hereditary disease that effects the mucus secreting glands of the body. The disease causes an overproduction of mucus that eventually fills the pulmonary lobes (i.e., lungs). The excess mucus must be removed daily to reduce its buildup and the attendant risk of infection. Presently, treatment involves an aerosol therapy three or four times a day to obtain bronchial drainage, along with a daily physical pounding on the chest cavity wall to loosen mucus within the lungs for expectoration. Daily treatment can range from four to six hours and requires a respiratory therapist or a trained individual to provide the pummeling of the chest.

Therapeutic devices for relieving a person from an accumulation of mucus within the lungs are generally known. U.S. Pat. No. 3,310,050 to Goldfarb discloses one such therapeutic device. The therapeutic device is a vest-like massaging garment designed to overlie the chest and back of a wearer. The massaging garment includes a plurality of electro-mechanical vibrators whose positions on the garment are adjustable to conform to the particular user. The vibrators are held in pockets arranged about the vest in three rows of three vibrators each, with an additional vibrator in an elevated position on the back of the user between the shoulder blades. The vibrators are operated in parallel from a 110 volt main power source. The massaging garment further includes a cyclic timer switch that sequentially switches power from the lowest to the middle and then to the upper row of vibrators.

Each electro-mechanical vibrator includes a disconnectable connection device which allows the vibrator to be disconnected and removed from one pocket in the vest and placed in another pocket at a different location. Each electro-mechanical vibrator is defined by a coil which acts to energize a laminated core so as to operate a magnetic armature attached to one side of the laminated core. The magnetic armature is somewhat elastic so as to be able to move up and down against the face of the laminated core in the rhythm of the current applied to the coil. The armature further includes a plastic cover that reduces the impact of the armature on the human body. The amplitude of vibration of the electro-mechanical vibrators is controlled by a rheostat. However, since the electro-mechanical vibrators are bulky by their nature, they protrude from the garment. These characteristics undoubtedly contribute to the cumbersome and uncomfortable nature of this garment.

It is evident that there is a continuing need for improved therapeutic massagers. In particular, there is a need for a therapeutic massager that is comfortable to wear. Moreover, there is a need for a therapeutic massager that is portable and efficiently applies vibrational forces to the body region requiring massage. A therapeutic massager of this type that is convenient-to-use and does not require the aid of others would be especially useful for people affected by cystic fibrosis.

SUMMARY OF THE INVENTION

The present invention is a comfortable, convenient-to-use and effective electro-magnetic impact massager. The impact massager includes a support member that is configured to be positioned adjacent a body region of a user. An electrically conductive element is movably supported within the support member and is adapted to repeatedly impact the body region and thereby provide a massaging effect. A drive mechanism is positioned adjacent the conductive element and is configured to produce a first pulsed magnetic field. The first pulsed magnetic field induces circulating currents within the conductive element which in turn produces a second magnetic field. The first and second magnetic fields interact to force the conductive element toward the body region of the user to impact thereupon. The drive mechanism is coupled to a drive circuit which periodically energizes the drive mechanism to intermittently force the conductive element toward the body region to produce a massaging effect.

In one embodiment the electro-magnetic impact massager includes a plurality of the electrically conductive elements. The conductive elements are movably supported within compartments formed in a frame supported within the support member. The support member is formed of a flexible fabric material, and includes an insulating cushion positioned between the conductive elements and the portion of the support member in contact with the body region of the user. A rigid element is positioned adjacent to the drive mechanism within the support member. The rigid element provides a zero expansion surface, such that the interaction of the first and second magnetic fields causes the conductive elements to move towards the body region.

The drive mechanism includes a plurality of drive coils mounted within the frame beneath the plurality of compartments which support the conductive elements. The drive circuit preferably includes a storage device in the form of a flat capacitor for storing electrical energy to be supplied to the drive coils. Switches in the form of silicon controlled rectifiers are connected in parallel with the capacitor and each of the drive coils. The silicon controlled rectifiers are switchable between a closed state which allows electrical energy to flow from the capacitor to the drive coils, and an open state which prevents any electrical energy from reaching the drive coils. A control signal generator in the form of a programmed microprocessor is coupled to the silicon controlled rectifiers and generates control signals that cause the rectifiers to switch between open and closed states. A power supply input is coupled to the capacitor by way of a resistive wire which limits the flow of electrical energy to the capacitor. Preferably, the conductive elements are percussive plates formed of paramagnetic metal such as aluminum.

The electro-magnetic impact massager can be incorporated into a vest-like therapeutic garment that covers the back and chest area of a wearer. In this form, the vibrational forces produced by the conductive elements impacting on the upper body can aid the loosening and elimination of mucus from the lungs of a person. Specifically, the impact massager would be useful to a person that is affected by cystic fibrosis.

This therapeutic impact massager is relatively uncomplicated and, due to its thin, layered geometry, is comfortable to wear. It is portable and efficiently applies vibrational forces to the body region of a user requiring massage. In addition, this therapeutic impact massager can be conveniently used by a person affected by cystic fibrosis without the aid of an additional person.

DETAILED DESCRIPTION OF THE PREFERRED EMBODIMENTS

Figure 2:
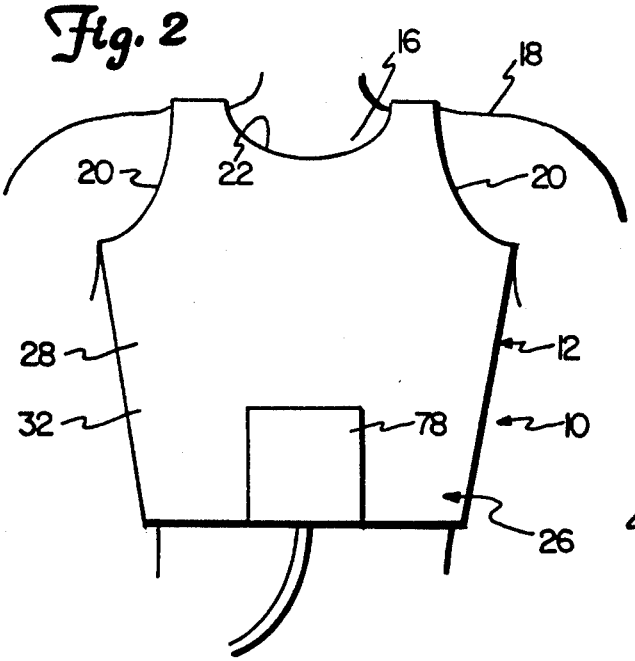
FIG. 2 is a rear elevational view of the therapeutic vest shown in FIG. 1.
Figure 3:
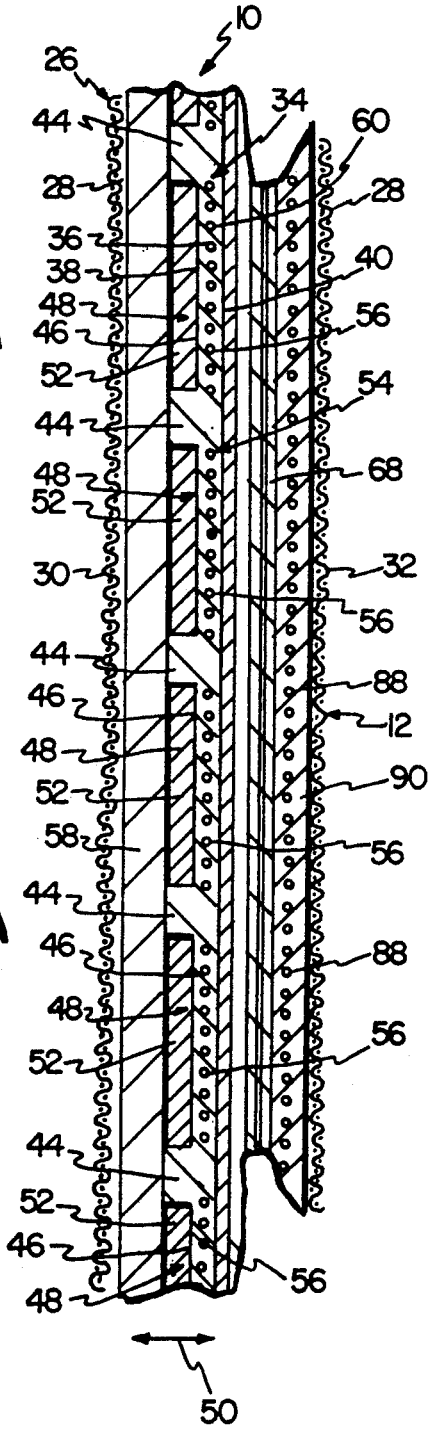
FIG. 3 is a cross sectional view taken along line 3—3 in FIG. 1 showing components of the electro-magnetic impact massager.
Figure 4:
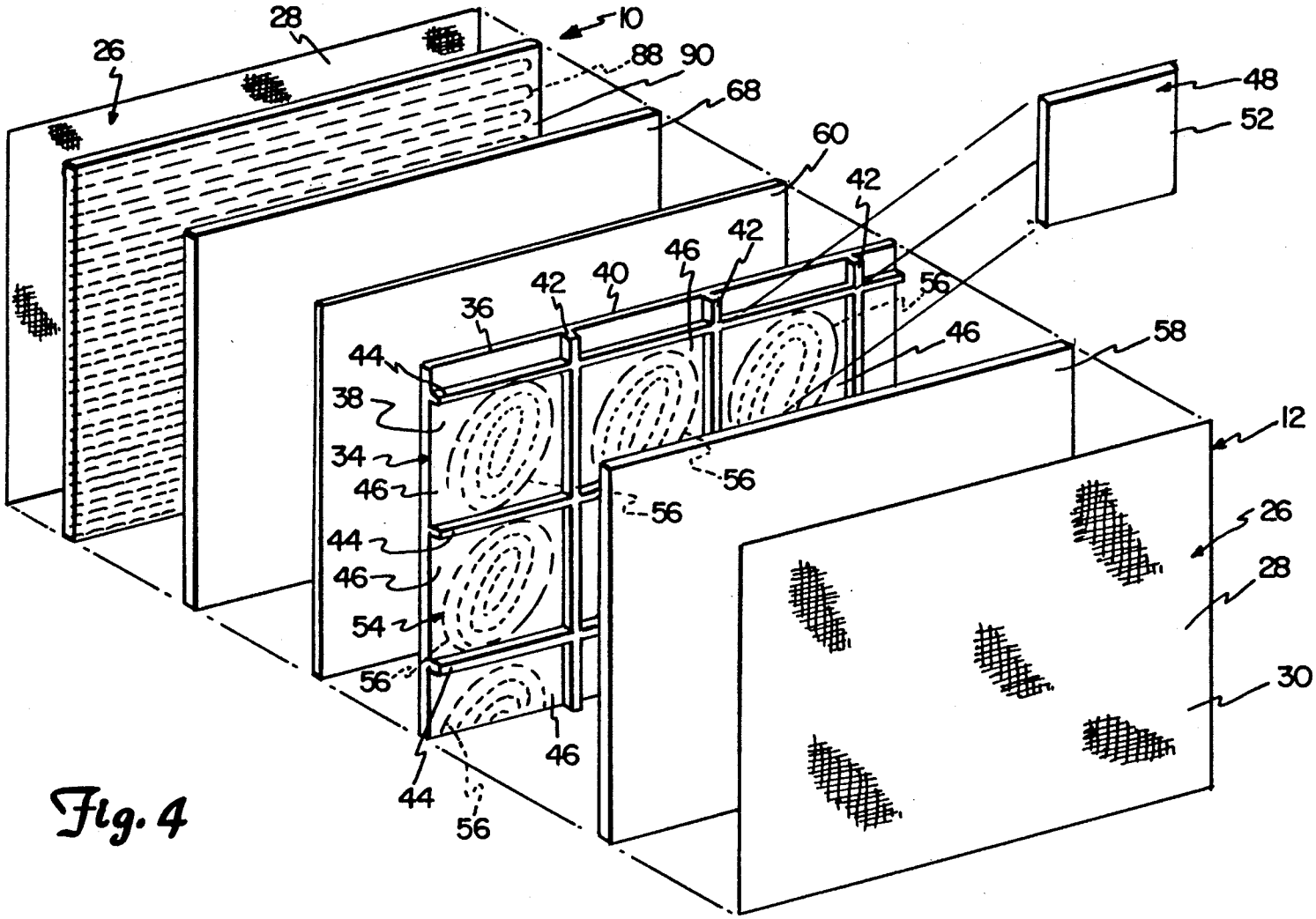
FIG. 4 is an exploded perspective view showing components of the electro-magnetic impact massager.
Figure 5:
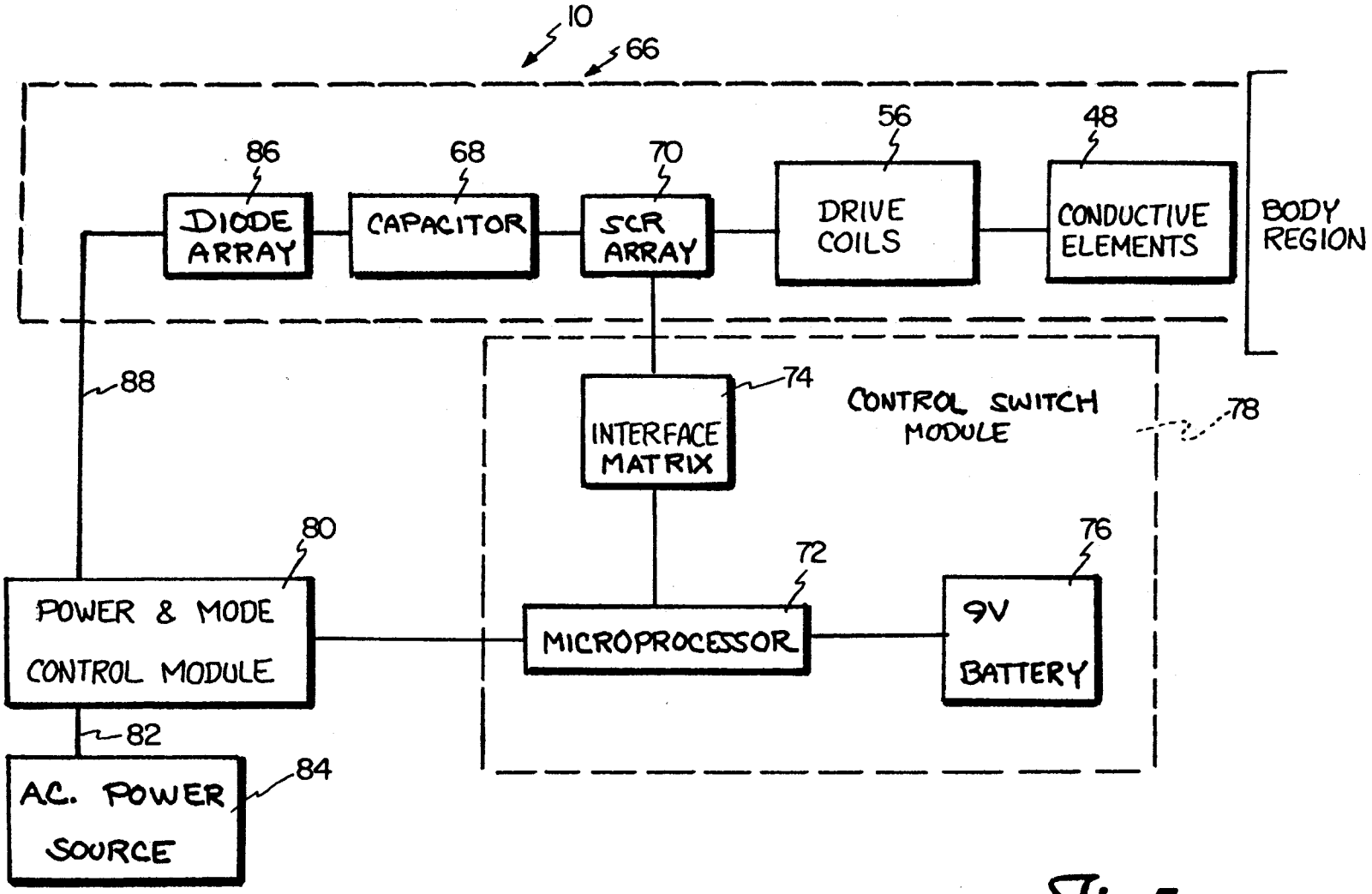
FIG. 5 is a block diagram of the components of the electro-magnetic impact massager of the present invention.

A therapeutic, electro-magnetic impact massager 10 in accordance with the present invention is illustrated in detail in FIGS. 3-5. In the preferred embodiment, the impact massager 10 is incorporated into a therapeutic, vest-like garment 12 (see FIGS. 1 and 2) that can be worn about the chest 14 and back 16 of a person. In this form the impact massager 10 aids in the loosening and elimination of mucus from the pulmonary lobes (i.e. lungs) of a person, such as a person 18 affected by cystic fibrosis. The therapeutic garment 12 includes a pair of arm openings 20 and a neck opening 22. Front flaps 24 of the therapeutic garment 12 can be releasibly secured together by conventional separable fasteners (not shown) that allow the therapeutic garment 12 to be put on and taken off as needed.

As seen in FIGS. 3 and 4, the electro-magnetic impact massager 10 incorporated into the therapeutic garment 12 includes a support member 26 formed of a flexible fabric material 28. The support member 26 includes an inner first side 30 that is configured to be positioned adjacent a body region (such as the chest 14 and back 16 of the person 18), and an outer second side 32. As seen in FIGS. 3 and 4, the support member 26 houses a frame member 34 that includes a panel element 36 having a first side 38 and an opposite second side 40. The first side 38 of the panel element 36 includes a plurality of first, raised divider walls 42 and a plurality of second, raised divider walls 44 extending perpendicular to the first divider walls 42. As seen in FIG. 4, the first and second divider walls 42 and 44 form a plurality of compartments 46 arranged on the first side 38 of the frame member 34.

The compartments 46 are configured to freely, movably support a plurality of conductive elements 48. The first and second divider walls 42 and 44 ensure that the conductive elements 48 move perpendicular to the first side 38 of the panel element 36 as represented by directional arrow 50 (see FIG. 3). As seen in FIGS. 3 and 4, one conductive element 48 is supported in each compartment 46. The conductive elements 48 are percussive plates 52 formed of paramagnetic metal such as aluminum. The conductive elements 48 are configured to move within the compartments 46 and impact the body region (such as the chest 14 and back 16 of the person 18) to provide a massaging effect.

As seen in FIGS. 3 and 4, the frame member 34 further includes a drive mechanism 54 supported within the panel element 36. The drive mechanism 54 includes a plurality of drive coils 56 molded within the panel element 36 adjacent to the plurality of compartments 46. One drive coil 56 is positioned beneath each compartment 46 and an associated conductive element 48. The drive coils 56 are configured to produce a first pulsed magnetic field in a direction perpendicular to the first side 38 of the panel element 36. The first magnet field will thereby impinge upon the adjacent conductive elements 48.

Since the first magnetic field is pulsed, it rapidly expands and retracts. This changing magnetic field induces circulating currents within the adjacent electrically conductive elements 48 in accordance with well known laws of electromagnetics. The circulating currents always tend to flow in a direction perpendicular to the first magnetic field and in such a direction as to oppose any changes in that magnetic field. The circulating currents, in turn, develop a second magnetic field which emanates from the conductive elements 48. The second magnetic field is oriented in a direction generally normal to the conductive elements 48 and is in an opposing direction to the first magnetic field.

The first magnetic field developed by the drive coils 56, and the second magnetic field developed by the conductive elements 48, are therefore opposed to one another. These fields interact to create a repulsive effect that forces the conductive elements 48 away from the first side 38 of the frame member 34 toward the body region to impact thereon.

As seen in FIGS. 3 and 4, an insulating cushion element 58 that provides both thermal and electrical insulation is positioned between the conductive elements 48 and the support member 26 adjacent the first side 38 of the panel element 36. The insulating cushion element 58 reduces the impact of the conductive elements 48 on the body region and evenly distributes the heat produced from the drive coils 56. A rigid element 60 is housed within the support member 26 adjacent to the second side 40 of the frame member 34. The rigid element 60 provides a zero expansion surface, such that the interaction of the first and second magnetic fields causes the conductive elements 48 to move away from the first side 38 of the panel element 36.

As seen in FIG. 5, the drive coils 56 of the drive mechanism 54 are coupled to a drive circuit 66. The drive circuit 66 is configured to periodically and in a patterned manner energize the drive coils 56 with large magnitude, current pulses. The current pulses applied to the drive coils 56 intermittently force the conductive elements 48 toward the body region to produce a massaging effect. The drive circuit 66 includes a storage device such as flat capacitor 68 for storing electrical energy to be supplied to the drive coils 56. The capacitor 68 can be discharged through the drive coils 56 and rapidly recharged. Alternatively, a number of capacitors 68 could be used. In this case each capacitor would be coupled to an associated drive coil 56.

A plurality of switches such as an array of silicon controlled rectifiers (SCR's) 70 (see FIG. 5) are connected in parallel between the flat capacitor 68 and the drive coils 56. Each SCR of array 70 is switchable between a closed state which allows electrical energy to flow from the flat capacitor 68 to the associated drive coils 56 of the drive mechanism 54, and an open state which prevents electrical energy from reaching the associated drive coils 56. The drive circuit 66 further includes a control signal generator such as programmed microprocessor 72 coupled to the array of SCR's 70. The microprocessor 72 generates a control signal that switches the SCR's of array 70 between the open and closed states.

As seen in FIG. 5, the drive circuit 66 further includes an interface matrix 74 connected in series between the array of SCR's 70 and the microprocessor 72. The control signal generated by the microprocessor 72 is in the form of a logic command which the interface matrix 74 converts to voltage levels compatible with the SCR's of array 70. The interface matrix 74 includes any known matrix of elements, such as buffers, that can perform this function. The microprocessor 72 can receive operational power to generate the logic command from a 9 volt battery 76. The interface matrix 74, microprocessor 72 and battery 76 form a control switch module 78 which is mounted to the rear of the therapeutic garment 12 as shown in FIG. 2.

Figure 1:
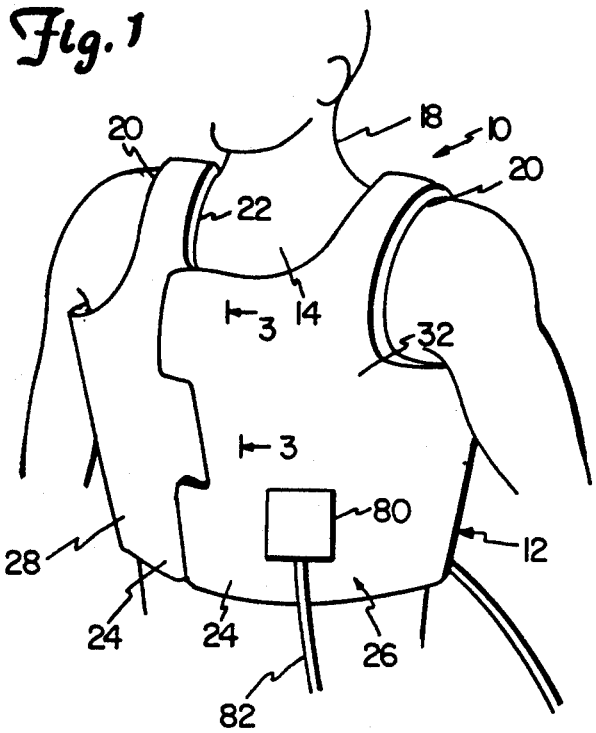
FIG. 1 is a perspective view of a therapeutic vest incorporating the electro-magnetic impact massager of the present invention.

As seen in FIG. 1, a power switch and mode control module 80 is mounted to the front of the therapeutic garment 12 and includes a power supply input cord 82 that is configured to be releasibly coupled to an AC power source 84 (see FIG. 5). As seen in FIG. 5, the power switch and mode control module 80 is coupled to the flat capacitor 68 through a rectifier such as diode array 86 that transforms alternating current from the AC power source 84 to direct current compatible with the flat capacitor 68. As seen in FIGS. 3-5, a resistive wire 88 molded within a resistive wire support member 90 is coupled in series between the power switch and mode control module 80 and the diode array 86. The inherent electrical resistance of resistive wire 88 limits the flow of electrical current to the diode array 86 and ultimately to the flat capacitor 68, and thereby produces heat that is transmitted to the inner first side 30 of the support member 26 to provide a soothing heat to the body region.

The power switch and mode control module 80 is designed to allow the user of the therapeutic garment 12 to control the frequency and amplitude of the current pulses that ultimately drive the conductive elements 48, by allowing the user to program the microprocessor 72. In the case of the person 18 affected by cystic fibrosis, the power and mode control module 80 can be used to program the microprocessor 72 such that the conductive elements 48 impart a rhythmic wave massaging effect to the chest 14 and back 16. The drive coils 56 of the drive mechanism 54 can be energized intermittently and in a sequential or progressive pattern so that the rhythmic massaging wave imparted by the vibrational forces of the conductive elements 48 travels from the lower edge to the neck opening 22 of the therapeutic garment 12. In this manner, accumulations of mucus within the lungs are driven upwardly in such a manner so as to allow easy expectoration.

As an alternative, the impact massager 10 can be incorporated into a rectangular pad (not shown) that can be placed in contact with any body region (such as a foot or thigh) of a person to soothe tired muscles or relieve stress. In addition, the storage device could include a plurality of capacitors 68. In this case each capacitor would be coupled to an associated drive coil 56 through a separate SCR of array 70.

Although the present invention has been described with reference to preferred embodiments, workers skilled in the art will recognize that changes may be made in form and detail without departing from the spirit and scope of the invention.

What is claimed is:

1. An impact massager for a body region of a person, comprising:

a support member configured to be positioned adjacent a body region, the support member including a frame having a plurality of compartments;

a plurality of electrically conductive elements movably supported within the plurality of compartments of the frame;

a drive mechanism including:

a plurality of drive coils positioned within the plurality of compartments and adjacent to the electrically conductive elements, each of the drive coils producing a first pulsed magnetic field, the first magnetic field inducing circulating currents within the respective conductive element which in turn produces a second magnetic field, the first and second magnetic fields interacting to force the respective conductive element in a first direction away from the respective drive coil toward a body region of a person; and a drive circuit coupled to the drive mechanism for periodically energizing the drive coils in a sequential, progressive manner to repeatedly force the conductive elements in the first direction away from the drive coils and repeatedly produce a rhythmic wave massaging effect that travels along a body region of a person directly adjacent the frame of the support member.

2. The impact massage of claim 1, and further including an insulating cushion within the support member positioned between the conductive elements and a body region of a person.

3. The impact massager of claim 1, and further including a rigid element within the support member positioned adjacent to the drive mechanism for providing a zero expansion surface, so that the interaction of the first and second magnetic fields causes the conductive elements to move in the first direction.

4. The impact massager of claim I wherein the drive circuit includes:

a storage device for storing electrical energy;

a switch connected in series with the storage device and drive mechanism, the switch having a closed state which allows electrical energy to flow from the storage device to the drive mechanism and an open state which prevents electrical energy from reaching the drive mechanism; and a control signal generator coupled to the switch for generating a control signal that shifts the switch between the open and closed states.

5. The impact massager of claim 4 wherein the control signal generator includes a microprocessor.

6. The impact massager of claim 4 wherein the switch includes a silicon controlled rectifier.

7. The impact massager of claim 4 wherein the storage device is a capacitor.

8. The impact massager of claim 7 wherein the capacitor is a flat capacitor mounted within the support member.

9. The impact massager of claim 4, and further including a power supply input and a resistive wire coupled between the power supply input and storage device for limiting the flow of electrical energy to the storage device.

10. The impact massager of claim 4 wherein the storage device includes a plurality of flat capacitors, each coupled to one of the plurality of drive coils.

11. The impact massager of claim 1 wherein the conductive elements are percussive plates formed of paramagnetic metal.

12. A therapeutic garment for massaging a body region of a wearer, comprising:

a support member configured to overlie a chest and back of a wearer;

a plurality of conductive elements;

a plurality of drive coils, each drive coil producing a first magnetic field, the first magnetic field inducing circulating currents within the respective conductive element which in turn produces a second magnetic field, the first and second magnetic fields interacting to force the respective conductive element in a first direction away from the respective drive coil to impact a chest and back of a wearer;

a frame supported within the support member and including a plurality of compartments for movably supporting the plurality of conductive elements, the drive coils being mounted within the plurality of compartments adjacent to the conductive elements; and a drive circuit coupled to the drive coils for periodically energizing the drive coils in a sequential, progressive manner to repeatedly force the conductive elements in the first direction away from the drive coils to repeatedly impart a rhythmic wave massaging effect to a chest and back of a wearer to drive concentrations of mucus out of the lungs of a wearer.

13. The therapeutic garment of claim 12 wherein the drive circuit energizes the drive coils with current pulses.

14. The therapeutic garment of claim 12, and further including an insulating cushion within the support member and positioned on a first side of the frame adjacent a chest and back of a wearer.

15. The therapeutic garment of claim 14, and further including a rigid element within the support member positioned on a second side of the frame for providing a zero expansion surface, so that the interaction of the first and second magnetic fields causes the conductive elements to move in the first direction.

16. The therapeutic garment of claim 12 wherein the drive circuit includes:

a capacitor for storing electrical energy;

a switch connected in series with the capacitor and drive coils, the switch having a closed state which allows electrical energy to flow from the capacitor to the drive coils and an open state which prevents electrical energy from reaching the drive coils; and a microprocessor coupled to the switch for generating a logic command that shifts the switch between the open and closed states.

17. The therapeutic garment of claim 16 wherein the capacitor is a flat capacitor mounted within the support member.

18. The therapeutic garment of claim 17, and further including:

a power supply input; and a resistor wire coupled between the power supply input and the flat capacitor for limiting the flow of electrical energy to the flat capacitor.

19. The therapeutic garment of claim 12 wherein the support member is formed of a flexible fabric material, and wherein the therapeutic garment is a vest.

* * * * *

UNITED STATES PATENT AND TRADEMARK OFFICE

CERTIFICATE OF CORRECTION

PATENT NO. : 5,235,967

DATED : August 17, 1993

INVENTOR(S) : Dominic S. Arbisi, et al

It is certified that error appears in the above-indentified patent and that said Letters Patent is hereby corrected as shown below:

Col. 6, line 35, delete "massage", insert --massager--

Col. 8. line 31, delete "resistor", insert --resistive--

Signed and Sealed this

Twenty-second Day of March, 1994

Bruce Lehman

*Attest:*

BRUCE LEHMAN

*Attesting Officer*

*Commissioner of Patents and Trademarks*